US005219695A

United States Patent [19]

Tanikawa

[11] Patent Number: 5,219,695

[45] Date of Patent: Jun. 15, 1993

[54] IMAGE FORMING METHOD

[75] Inventor: Hirohide Tanikawa, Yokohama, Japan

[73] Assignee: Canon Kabushiki Kaisha, Tokyo, Japan

[21] Appl. No.: 618,364

[22] Filed: Nov. 21, 1990

[30] Foreign Application Priority Data

Nov. 22, 1989 [JP] Japan ..... 1-302203

[51] Int. Cl.[5] ..... G03G 9/14

[52] U.S. Cl. ..... 430/106.6; 430/109; 430/110; 430/111

[58] Field of Search ..... 430/106.6, 109, 110, 430/111, 126, 106

[56] References Cited

U.S. PATENT DOCUMENTS

| | | | |
|---|---|---|---|
| 3,909,258 | 9/1975 | Kotz | 430/106.6 |
| 4,336,318 | 6/1982 | Fukumoto et al. | 430/120 |
| 4,518,673 | 5/1985 | Noguchi et al. | 430/108 |
| 4,622,281 | 11/1986 | Imai et al. | 430/107 |
| 4,946,755 | 8/1990 | Inoue | 430/106.6 |
| 4,978,597 | 12/1990 | Nakahara et al. | 430/122 |
| 4,999,272 | 3/1991 | Tanikawa et al. | 430/106.6 |

FOREIGN PATENT DOCUMENTS

| | | |
|---|---|---|
| 0323252 | 7/1989 | European Pat. Off. . |
| 0331425 | 9/1989 | European Pat. Off. . |
| 0331426 | 9/1989 | European Pat. Off. . |
| 043037 | 4/1979 | Japan . |
| 018656 | 2/1980 | Japan . |
| 018659 | 2/1980 | Japan . |
| 57-38440 | 3/1982 | Japan . |
| 066455 | 4/1982 | Japan . |
| 57-066455 | 4/1982 | Japan . |

*Primary Examiner*—Marion E. McCamish
*Assistant Examiner*—Rosemary Ashton
*Attorney, Agent, or Firm*—Fitzpatrick, Cella, Harper & Scinto

[57] ABSTRACT

An image forming method comprises the steps of feeding a magnetic toner onto a toner carrying member, wherein the magnetic toner comprises a binder resin and a magnetic powder with a volume average particle diameter ranging from 7 μm to 10 μm, and the magnetic toner particles have a quantity of triboelectric charge which satisfies the following expression:

$$0.1 \times A + 2 \leqq -Q \leqq 0.1 \times A + 16.$$

The magnetic toner is triboelectrically charged to impart a negative triboelectric charge to the magnetic toner. An electrostatic latent image is formed on a latent image carrying member by using the magnetic toner to form a toner image. Thereafter, the toner image is transferred to a transfer medium.

27 Claims, 8 Drawing Sheets

IMAGE FORMING METHOD

BACKGROUND OF THE INVENTION

1. Field of the Invention

The present invention relates to an image forming method, and an image forming apparatus, in which an electrostatic latent image formed in an image forming process such as electrophotography, electrostatic printing and electrostatic recording is developed with a magnetic toner.

2. Related Background Art

As a developing method making use of a one-component magnetic toner, the developing method using a conductive magnetic toner as disclosed in U.S. Pat. No. 3,909,258, etc. is known in the art.

In such a developing method, however, toners are required to be substantially conductive, and, in the case of conductive toners, it has been difficult to transfer a toner image formed on a latent image carrying member to a final image supporting member, e.g., plain paper, by utilizing an electric field.

A proposal has been made on a novel developing method that can solve problems involved in developing methods making use of conventional one-component magnetic toners (for example, Japanese Patent Applications Laid-open No. 55-18656 and No. 55-18659). According to this method, an insulating magnetic toner is uniformly applied to a cylindrical toner carrying member having a magnet in its inner part, and the toner carrying member is opposed to a latent image carrying member without being in contact therewith, in the state of which development is carried out. As a method of forming a magnetic toner layer on the toner carrying member, there is a method in which a coating blade is used, provided at an outlet of a toner container. For example, the image forming apparatus illustrated in FIG. 1 comprises a toner carrying member 2, and a blade Ia comprised of a magnetic material, provided at the position opposed to a magnetic pole N1 of a fixed magnetic built in the toner carrying member 2. A magnetic toner is caused to rise along the magnetic line of force between the magnetic pole and the magnetic material blade, and the toner having risen is cut with an edge at the tip of the blade so that the thickness of the magnetic toner layer can be controlled by utilizing the action of the magnetic force (see for example, Japanese Patent Application Laid-open No. 54-43037).

At the time of development, a low-frequency alternating voltage is applied between the toner carrying member and a conducting base body of the latent image carrying member so that the magnetic toner may reciprocate between the toner carrying member and the latent image carrying member. Desired good development can be thus carried out. In this developing method, the magnetic toner has insulation properties and hence can be readily electrostatically transferred.

The image forming apparatus illustrated in FIG. 2 is equipped with a developing device 7 holding therein a toner 10, and a latent image carrying member 9 such as a photosensitive drum used in electrophotography or an insulating drum used in electrostatic recording (hereinafter "photosensitive member" or "photosensitive drum").

In the developing method making use of such apparatus, very important are the subject (A): to uniformly apply the magnetic toner to the toner carrying member and the subject (B): to prevent or decrease contamination on the surface of the toner carrying member, caused by some constituents in the magnetic toner. The subject (A) and the subject (B), however, have the relation that they conflict with each other, and it is difficult to settle both of them at the same time.

In the subject (A), as a method of uniformly applying the magnetic toner to the toner carrying member, a proposal is made on a developing device capable of forming a toner coat layer on a toner carrying member in a stable state for a period long enough from a practical viewpoint (Japanese Patent Application Laid-open No. 57-66455). This developing device is a superior developing device, which is comprised of a toner carrying member made to have a rough surface with a specific irregularity by sandblasting using amorphous particles and thus can maintain on the surface of the toner carrying member the state of a toner coat that is uniform, free from uneveness and always good for a long period of time. As shown in FIG. 10, a cylindrical toner carrying member has an embodiment in which its surface is provided over the entire surface with numberless cuts or protuberances formed in random directions.

In the developing device comprised of a toner carrying member having such a specific surface state, some of magnetic toners to be applied tend to cause adhesion of a toner or constituents in a toner to the surface of the toner carrying member. Hence the surface of the toner carrying member may be contaminated, consequently tending to cause a lowering of image density at the initial stage and, when it has become more contaminated as a result of copying on a large number of sheets, cause image blank areas to occur in every period of rotation of the toner carrying member. This is due to the fact that the constituents in a toner adhere to the slopes of projections end the hollows or concavities, of the surface of the toner carrying member to cause poor static charge of magnetic toner particles, resulting in a lowering of the quantity of static charge in a magnetic toner layer.

In general, the constituents of a magnetic toner are formed of materials such as a binder resin, a magnetic material, a charge control agent and a release agent. Materials are selected so that the contamination on the surface of the toner carrying member can be prevented. Hence, under present circumstances, the materials are limited.

In the subject (B), as a method of preventing or decreasing contamination on the surface of the toner carrying member, it has been clear that it is advantageous to make smoother the surface of a toner carrying member. Such a method, however, is experimentally found to tend to bring about a non-uniform toner coat when a magnetic toner has a volume average particle diameter of 12 $\mu$m or more, to cause uneveness in toner images, often resulting in no formation of good toner image. The phenomenon in which this non-uniform toner coat is formed was observed in detail by carrying out running of a developing device without image-copying to reveal the following.

At the initial stage of the running without image-copying, the toner coat layer becomes excessively thick when the surface of the toner carrying member is smooth, although its cause is unclear. When the toner thickness is controlled using the blade 1*a*, the toner gradually comes to bulge out on the photosensitive member 9 side of the blade 1*a* (the part A in FIG. 2). As shown in FIG. 3 as a partially enlarge cross section, the toner forms a heap 10*a* at the part A. When this toner heap reaches a certain limit quantity, it moves to the surface of a sleeve 2 on the outside of the toner container because of the transporting force of the sleeve 2 to give coat uneveness 3*a*. When the coat uneveness 3*a* (a toner mass) is present on the toner layer 3 formed in a uniform coating, this uneveness comes out as an uneveness on a toner image. The latter uneveness corresponds to density uneveness and fog. The toner coat uneveness 3*a* is found to have the shape of a rectangular spot, a wavelike spot, a wavelike pattern, or the like.

As discussed above, it has been very difficult for the conventional developing method to settle both the subject (A) and the subject (B) at the same time. This tendency becomes more remarkable under conditions of a low humidity or in a developing device designed to have a toner carrying member that rotates at a higher peripheral speed.

With an intent to improve image quality, European Patent Application Publication No. 0314459 proposes a magnetic toner having a volume average particle diameter of from 4 μm to 9 μm and also having a specific particle size distribution, and an image forming apparatus making use of such a magnetic toner.

European Patent Application Publication No. 0331425 also proposes an image forming method in which a magnetic toner having a volume average particle diameter of from 4 μm to 9 μm and also having a specific particle size distribution is fed to a toner carrying member having the surface with an uneveness comprising sphere-traced concavities and thus an electrostatic latent image is developed.

It, however, has been sought to provide a more improved image forming method or apparatus that has been adapted to the developing speed made increasingly higher.

SUMMARY OF THE INVENTION

An object of the present invention is to provide an image forming method and an image forming apparatus that have solved the problems discussed above.

Another object of the present invention is to provide an image forming method and an image forming apparatus that can form a good toner image even in the development carried out at a high speed.

Still another object of the present invention is to provide an image forming method and an image forming apparatus that have superior environmental stability.

A further object of the present invention is to provide an image forming method and an image forming apparatus that have superior durability to copying on a large number of sheets.

A still further object of the present invention is to provide an image forming method and an image forming apparatus that can form a good toner image having a good resolution and gradation.

A still further object of the present invention is to provide an image forming method and an image forming apparatus that can obtain fog-free and sharp high-quality images with a high image density and a superior fine-line reproduction and gradation.

According to the present invention, there is provided an image forming method comprising;

feeding a magnetic toner onto a toner carrying member disposed with a given gap relative to a latent image carrying member, wherein said magnetic toner comprises a binder resin and a magnetic powder and has a volume average particle diameter of from 7 μm to 10 μm, quantity of triboelectricity of magnetic toner particles satisfy the following expression:

$$0.1\times A+2\leqq -Q\leqq 0.1\times A+16$$

wherein A represents a real number of from 25 to 45 calculated as a coefficient of variation of number distribution, $(S/\overline{D}_1)\times 100$, wherein S represents a standard deviation of the number distribution of magnetic toner particles and $\overline{D}_1$ represents a number average particle diameter (μm), and Q represents a value of the quantity of triboelectricity (μc/g) of the magnetic toner produced by friction with an iron powder;

triboelectrically charging said magnetic toner to impart a negative triboelectric charge to said magnetic toner;

forming an electrostatic latent image on said latent image carrying member;

developing said electrostatic latent image by the use of said magnetic toner having the negative triboelectric charge to form a toner image; and transferring said toner image formed on said latent image carrying member to a transfer medium.

According to another aspect of the present invention, there is provided an image forming apparatus comprising a developing means comprising a latent image carrying member, a toner carrying member and a toner container, for developing an electrostatic latent image formed on the latent image carrying member, and a transfer means for transferring to a transfer medium a toner image formed on the latent image carrying member;

said latent image carrying member and said toner carrying member being disposed with a given gap;

said toner container holding a magnetic toner, said magnetic toner being fed onto the toner carrying member, wherein;

said magnetic toner comprises a binder resin and a magnetic powder and has a volume average particle diameter of from 7 μm to 10 μm, and the number distribution and quantity of triboelectricity of magnetic toner particles satisfy the following expression:

$$0.1\times A+2\leqq -Q\leqq 0.1\times A+16$$

wherein A represents a real number of from 25 to 45 calculated as a coefficient of variation of number distribution, $S/\overline{D}_1\times 100$, wherein S represents a standard deviation of the number distribution of magnetic toner particles and $\overline{D}_1$ represents a number average particle diameter (μm), and Q represents a value Of the quantity of triboelectricity (μc/g) of the magnetic toner produced by friction with an iron powder.

BRIEF DESCRIPTIONS OF THE DRAWINGS

DESCRIPTION OF THE PREFERRED EMBODIMENTS

In the case when the surface of a toner carrying member is smooth or has a specific uneveness comprising sphere-traced concavities, constituents of a magnetic toner may adhere to the surface with difficulty and the contamination of the surface can be prevented or decreased over a long period of time. Hence the toner carrying member may not cause a lowering of the ability of imparting static charge and the magnetic toner can be efficiently charged in a stable state over a long period of time. However, compared with the toner carrying member having an irregular surface provided with numberless cuts or protuberances formed in random directions by sand-blasting using amorphous particles, the above toner carrying member may be a little inferior, under specific conditions, in the performance of enabling the magnetic toner to be uniformly applied to the toner carrying member to form a toner coat. For example, in the case when a magnetic toner with a great chargeability is used in a high-speed machine under conditions of a low humidity, the quantity of triboelectricity of the magnetic toner becomes large because of the toner carrying member having a large ability of imparting static charge, so that the mirror image force to the toner carrying member becomes great and at the same time &he agglomeration force of the magnetic toner becomes great, causing agglomerates of the magnetic toner to be formed on the toner carrying member and also causing a toner coat uneveness to occur.

In the present invention, the toner coat layer can be prevented from becoming excessively thick even with use of various toner carrying members, when the magnetic toner has a volume average particle diameter of from 7 μm to 10 μm, has a specific particle size distribution and has an appropriate quantity of triboelectricity. Thus, no toner coat uneveness may occur and the magnetic toner can be uniformly applied over a long period of time.

As a result, fog-free and sharp high-quality toner images with a high image density and a superior fine-line reproduction and gradation can be obtained over a long period of time.

The present invention will now be described in detail. The toner carrying member is hereinafter referred to as "sleeve".

Figure 9:
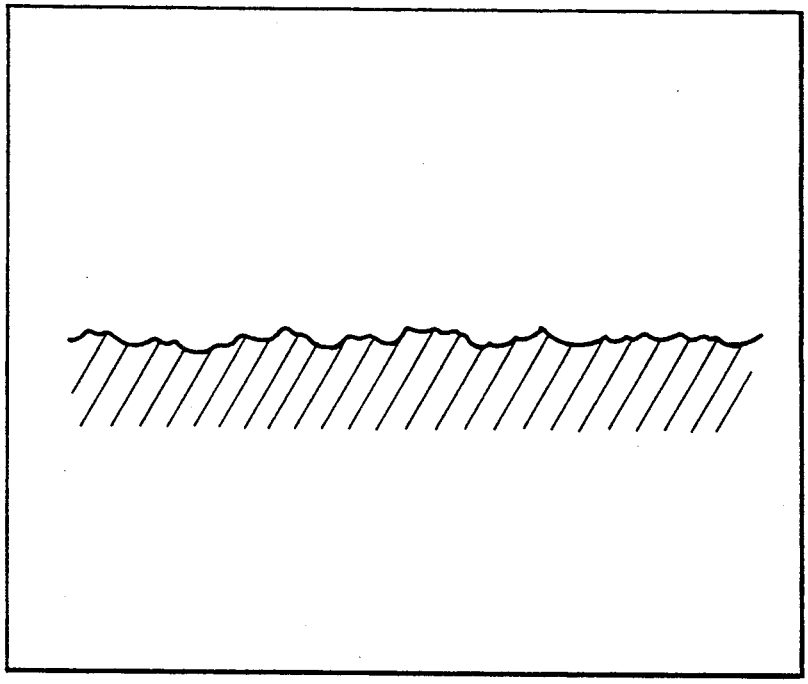
FIG. 9 is a partial cross section to schematically illustrate the surface of a sleeve having been blast-finished using spherical particles with a uniform shape.

The sleeve that is used to carry the magnetic toner of the present invention may preferably have a surface provided thereon with irregularities comprising traced concavities formed by plural spheres. As a method of obtaining such a surface state, the blast finishing using particles with a uniform shape can be used. Such particles thai can be used include balls of rigid bodies formed of metals such as stainless steel, aluminum, steel, nickel and brass; or balls of rigid bodies formed of materials such as ceramics, plastics and glass beads. The surface of the sleeve may be blast-finished using uniform particles having a specific particle diameter, whereby the plural traced concavities within a specific range as shown in FIG. 9 can be formed.

The balls that form the plural traced concavities o the sleeve surface may particularly preferably have a diameter R of from 20 μm to 250 μm. Balls with a diameter R less than 20 μm tend to result in an increase in the contamination due to the constituents of the magnetic toner. On the other hand, balls with a diameter R more than 250 μm tend to result in a lowering of the uniformity of the toner coat formed on the sleeve. Thus, the concavities on the sleeve surface may preferably have a diameter of not more than 250 μm, and more preferably from 20 μm to 250 μm. In the present invention, the pitch P of the irregularities on the sleeve surface and the surface roughness d are obtained by measuring the sleeve surface by the use of a micro-surface roughness meter (available from Tailer Hobson Co., Kosaka Kenkusho, etc.) The surface roughness d is in accordance with the JIS 10-point average roughness (RZ) as prescribed in JIS B-0601.

Figure 4:
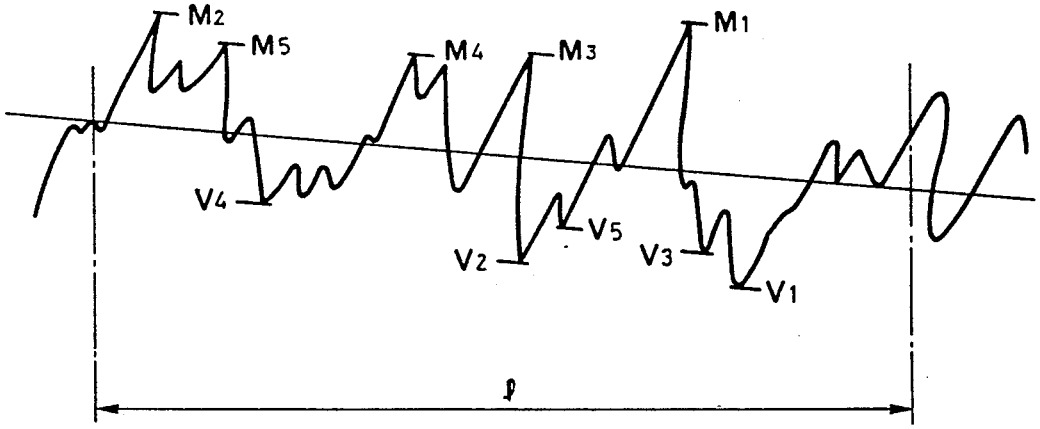
FIG. 4 is an illustration to explain the surface roughness and pitches.

As shown in FIG. 4, the space between two lines consisting of straight lines parallel to an average line of a part extracted by the standard length l from a profile curve, one of which is a line that passes the top of a hill or mountain which is the third from the highest and the other of which is a line that passes the bottom of a valley which is the third from the deepest, is expressed in micrometer (μm). The standard length l is set to be 0.25 mm. The pitch P is based on the number of hills or mountains included in the standard length of 0.25 mm when the projected part with a height not less than 0.1μ with respect to the concaved parts on its both sides is counted as one mountain, and is determined in the following way:

$$[250\ (\mu)]/[\textit{number of mountains included in}\ 250\ (\mu)]$$

The pitch P of irregularities of the sleeve surface may preferably be in the range of from 2 μm to 100 μm. Irregularities with a pitch P less than 2 μm tend to result in an increase in the contamination of the sleeve, caused by the constituents of the magnetic toner. On the other hand, irregularities with a pitch P more than 100 μm tend to result in a lowering of the uniformity of the toner coat formed on the sleeve. The surface roughness d of the irregularities on the sleeve surface may preferably be in the range of from 0.1 μm to 5 μm. Irregularities with a surface roughness d more than 5 μm tend to give disordered images because of a concentration of electric fields to the part at which the irregularities are present, in a system in which development is carried out by applying an alternating voltage between a sleeve and a latent image carrying member so that a magnetic toner is made to fly from the sleeve side to a latent image surface. On the other hand, irregularities with a roughness d lees than 0.1 μm tend to result in a lowering of the uniformity of the toner coat formed on the sleeve.

The blast finishing using the particles with a uniform shape may be further carried out on a sleeve surface having been already subjected to a blast treatment using amorphous particles.

The uniformly shaped blast particles may preferably be larger than the amorphous blast particles. The former may particularly preferably be from 1 time to 20 times, and more preferably from 1.5 times to 9 times, the latter.

When the blast finishing using uniform particles is overlappingly carried out, it is also preferred that at least one of the blasting time and the force of collision of blast particles is controlled to be smaller than that for the blasting using amorphous blast particles.

It is also possible to use blast finishing in which the amorphous particles and the uniformly shaped particles are simultaneously used. Any abrasives can be used as the amorphous particles. In this instance, the pitch and the roughness are different from those in the case of the uniformly shaped particles.

The negatively chargeable magnetic toner according to the present: invention is for one thing characterized in that it has a volume average particle diameter in the range of from 7 μm to 10 μm, and a coefficient of variation of number distribution in the range of from 25 to 45, preferably from 26 to 44, and more preferably from 27 to 43.

The coefficient of variation (or variation coefficient) is a value that shows the state of variation from an average value. A magnetic toner with the coefficient of variation and particle size distribution as desired can be obtained by controlling classification conditions in the process of producing the toner and carrying out strict classification. It is meant that the particle size distribution becomes sharper as the variation coefficient becomes smaller and the former becomes broader as the latter becomes larger. However, the variation coefficient is also a measure embracing the state of variation corresponding to the number average particle diameter of a magnetic toner. Hence, it can not be enough that fine powder and coarse powder are merely classified and removed. The magnetic toner of the present invention can be obtained by determining the particle size distribution of starting materials for fine grinding, and carrying out the classification carefully while controlling the classification conditions (i.e., condition for setting edge distance, differential pressure, etc. in the case of Elbow-Jet classifying) with referring to its peak value, the content of ultrafine powder to fine powder or of particles having a particle size adjacent to the particle size at which the number distribution shows a peak value, and the content of coarse powder.

Figure 2:
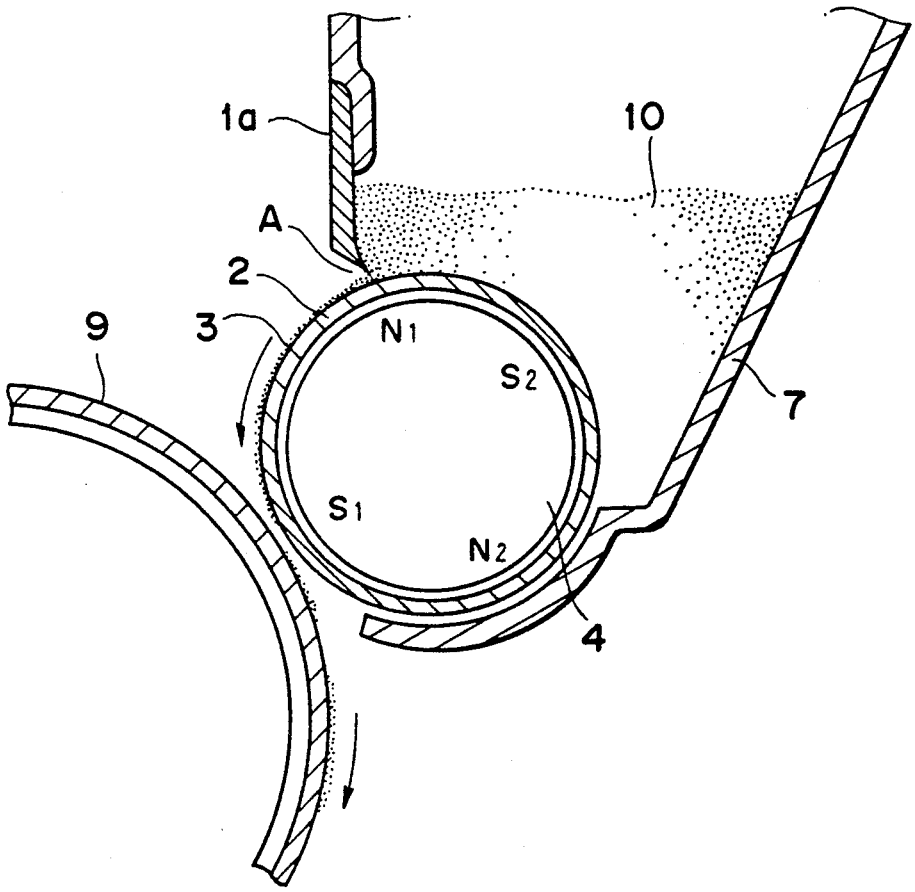
FIG. 2 is a cross-sectional illustration of a developing device in which a magnetic blade is used.
Figure 3:
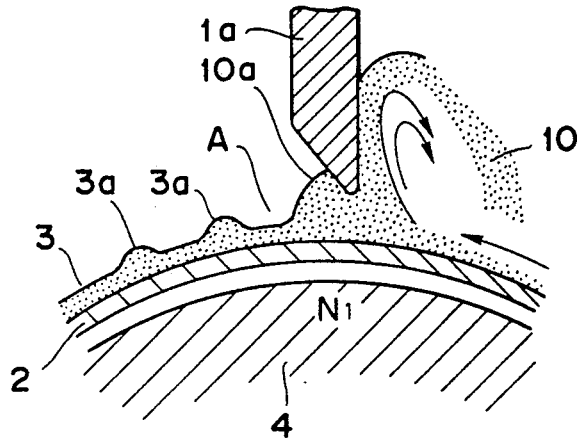
FIG. 3 is an illustration to explain how a toner coat uneveness is caused.

As previously described, the sleeve most preferred for its use in combination with the negatively chargeable magnetic material according to the present invention (hereinafter "the present sleeve 2-1" is the sleeve having the surface with specific irregularities comprising the plural traced concavities formed by blast finishing using spherical uniform particles. Compared with the sleeve having the irregular surface formed by sandblasting using amorphous particles (hereinafter "the comparative sleeve 2-2"). the above sleeve is a little inferior. under specific environmental conditions, in the performance of enabling the magnetic toner to be uniformly applied to the sleeve to form a toner coat. This is a result obtained by an experiment. Namely, when a negatively chargeable magnetic toner with a volume average particle diameter of not less than 12 μm is fed to each of a developing device having the present sleeve 2-1 and a developing device having the comparative sleeve 2-2, to carry out the running without image-copying in a specific environment of a temperature of 15° C. or less and a humidity of 10% or less, the weight M/S per unit area, of the magnetic toner layer formed on the sleeve is in the range of from 1.6 mg/cm$^2$ to 2.5 mg/cm$^2$ in the case of the present sleeve 2-1 and from 0.6 mg/cm$^2$ to 2.0 mg/cm$^2$ in the case of the comparative sleeve 2-2. The toner coat layer on the present sleeve 2-1 has a larger thickness, and it has been confirmed that in some instances a toner coat uneveness like the one as shown in FIG. 2 may occur on the present sleeve 2-1 after the running without image-copyinq is carried out for a long period of time.

However, according to studies made by the present inventors, although the reason is not necessarily clear, the M/S on the sleeve was in the range of from 0.5 mg/cm$^2$ to 2.0 mg/cm$^2$ even in the case of the present sleeve 2-1, as a result of a similar experiment carried out using the negatively chargeable magnetic toner having the particle size distribution as defined in the present invention. Thus they have found that the toner coat thickness can be be decreased. They have also found a fact that even after the running without image-copying is continued for a long time the decrease in the toner coat thickness is very effective for making the toner coat layer uniform over a long period of time.

On the other hand, it has been found that some magnetic toners, even the negatively chargeable magnetic toner having a volume average particle diameter in the range of from 7 μm to 10 μm and a variation coefficient of number distribution in the range of from 25 to 45, may cause the formation of agglomerates of the magnetic toner on the sleeve to bring about a toner coat uneveness on the sleeve, when the peripheral speed of the sleeve is made as high as 220 mm/sec or more and the running without image-copying is carried out for a longer time under conditions of a low humidity. It has been also found that the agglomerates of the magnetic toner are formed in a shorter time as the peripheral speed of the sleeve becomes higher. The quantity of triboelectricity of the magnetic toner before the toner coat uneveness occurred on the sleeve became larger as the time lapses for the running without image-copying, and became considerably larger than that of the magnetic toner that caused no toner coat uneveness on the sleeve. These magnetic toners were each mixed with iron powder to measure the quantity of triboelectricity to reveal that the former showed a larger value than the latter.

Thus, it has been found that the toner coat uneveness on the sleeve occurs under conditions of a low humidity for the reason stated above when the magnetic toner that may result in a larger quantity of triboelectricity is used in a high-speed machine.

If the volume average particle diameter is in the range of from 7 μm to 10 μm but the variation coefficient of number distribution is less than 25, the M/S on the sleeve may increase although the reason therefor is not clear, tending to readily cause toner coat uneveness on the sleeve. If it is more than 45, the particle size distribution becomes broader and hence the triboelectricity between magnetic toner particles become nonuniform, tending to cause a lowering of density, and also resulting in a disturbance of the rise of toner on the sleeve to bring about coarse images or a lowering of resolution.

The variation coefficient of number distribution, represented by A, can be controlled in a classification step.

Within the range of from 25 to 45 for the variation coefficient, the magnetic toner can be uniformly applied to the sleeve to give a good coat and also good toner images can be obtained, when the quantity of triboelectricity of magnetic toner particles to iron powder is in the range of the expression: $0.1\times A+2\leqq -Q\leqq 0.1\times A+16$, preferably $0.1\times A+3\leqq -Q\leqq 0.1\times A+15$, and more preferably $0.1\times A+4\leqq -Q\leqq 0.1\times A+14$.

An instance of $-Q>0.1\times A+16$ (i.e., an instance in which the quantity of triboelectricity of the magnetic toner is too large) may result in a charge excess on the sleeve to tend to cause toner coat uneveness on the sleeve, when the sleeve is rotated at a high speed (220 mm/sec or more in peripheral speed) under conditions of a low humidity.

On the other hand, an instance of $Q<0.1\times A+2$ (i.e., an instance in which the quantity of triboelectricity is too small) may result in no sufficient developability of the toner and a low density, making it impossible to obtain good toner images. The triboelectric charge characteristics of the magnetic toner can be controlled by selecting charge control agents and/or magnetic materials or by adjusting the amounts in which they are used.

The magnetic toner on the sleeve should have a quantity of triboelectricity R of from $-6$ μc/g to $-19$μc/g, and preferably from $-7$ μc/g to $-18$ μc/g. In addition, it is preferred that the magnetic toner is triboelectrically charged in a developing device so that the quantity of triboelectricity R has a difference from the quantity Of triboelectricity Q measured when the magnetic toner and iron powder are mixed, in the range of from 0 μc/g to 10 μc/g, and preferably from 0 μc/g to 8 μc/g, as an absolute value.

The magnetic toner having the particle size distribution and quantity of triboelectricity according to the present invention causes no disturbance in the rise of toner on the developing sleeve and is in a thin, short and uniform state. Hence, it can give fog-free sharp toner images with a superior fine-line reproduction and gradation.

Moreover, the magnetic toner of the present invention can be uniformly transferred to a transfer medium, and hence it has a superior gradation and also can give a high image density even with a decrease in the toner consumption.

When a magnetic toner is produced, it tends to result in a magnetic toner that may give a large quantity of triboelectricity, if toner materials are pulverized using a grinding mill of a mechanical system making use of members such as a pin, a disk, a rotor and a liner, or gently pulverized under a lowered air pressure in a jet mill. In such an instance, the magnetic toner coat on the sleeve may become non-uniform. Hence, when the magnetic toner is produced, it is important to carry out pulverization using a jet mill under an appropriate air pressure of from 4–7 kg/cm$^2$. The smooth developing sleeve as previously mentioned has a superior ability of imparting triboelectricity and hence can effectively make the magnetic toner triboelectrically charged. Since the quantity of triboelectricity of the magnetic toner on the sleeve is stable, it is possible to always maintain a high image density and a high image quality.

Figure 5:
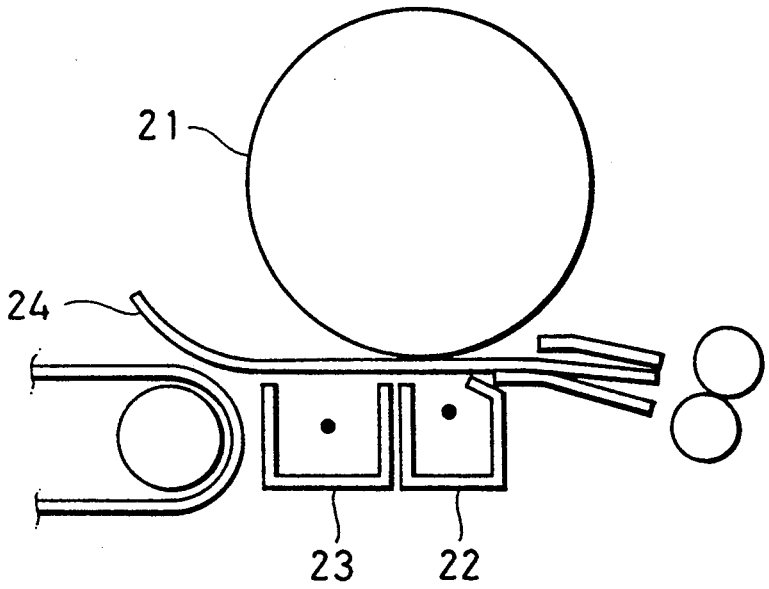
FIG. 5 is a schematic illustration of a transfer device and a separation device.

After an electrostatic latent image has been developed with the magnetic toner, the resulting toner image is transferred using a transfer device 22 as shown in FIG. 5, in which a charge with a polarity opposite tO the magnetic toner is applied to the back of a transfer medium 24 so that the toner image is transferred from a latent image carrying member 21 to the transfer medium 24 by the action of an electrostatic attraction force.

Immediately after the transfer step, in a separation device 23, an AC corona is applied to the back of the transfer medium 24 to remove electricity from the transfer medium 24 so that the transfer medium can be separated from the latent image carrying member 21. In such an image forming method, the adhesion between the latent image carrying member 21 and the transfer medium 24 becomes stronger when the magnetic toner is made to have a smaller particle diameter. This is disadvantageous in the separation step.

In the case when the magnetic toner has a small quantity of triboelectricity, its adhesion to the transfer medium is so poor that a poor transfer of the magnetic toner to the latent image carrying member 21 may occur at the stage of separation to cause a defect that an image has blank areas. On the other hand in the case when the magnetic toner has a large quantity of triboelectricity, the magnetic toner tends to be non-uniformly transferred to the transfer medium, and also the magnetic toner may be retransferred to the latent image carrying member 21, when the transfer medium is separated from the latent image carrying member 21.

In the present invention, the magnetic toner has been controlled to have an appropriate quantity of triboelectricity in the developing step, and hence can be preferably used in the image forming method as described above.

The particle size distribution of the magnetic toner can be measured by various methods. In the present invention, it is measured using a Coulter counter.

Using as a measuring apparatus a Coulter counter TA-II Type (manufactured by Coulter Electronics Inc.), an interface capable of outputting number distribution and volume distribution (manufactured by Nikkaki K.K.) and a CX-1 personal computer (manufactured by Canon Inc.) are connected. As an electrolytic solution used in the measurement, an aqueous 1 % NaCl solution is prepared using first grade sodium chloride. For example, ISOTON-II (trademark; available from Coulter Scientific Japan) can be used. To carry out the measurement, 0.1 to 5 ml of a surface active agent (preferably an alkylbenzene sulfonate) as a dispersant is added in 100 to 150 ml of the above aqueous electrolytic solution, and then 2 to 20 mg of a sample to be measured is added. The electrolytic solution in which the sample has been suspended is dispersed for about 1 minute to about 3 minutes using an ultrasonic dispersion machine, and the particle size distribution of particles of 2 to 40 μm on the basis of number is measured by means of the above Coulter counter TA-II Type, using a 100 μm aperture as an aperture. The value according to the present invention is determined from the measured values.

As the binder resin used in the magnetic toner of the present invention, the following binder resins used for toners can be used when a heating press roller fixing device having a device for applying an oil is used.

They include, for example, polystyrene; homopolymers of a substitution product of styrene, such as poly-p-chlorostyrene, and polyvinyltoluene; styrene copolymers such as a styrene/p-chlorostyrene copolymer, a styrene/vinyltoluene copolymer, a styrene/vinylnaphthalene copolymer, a styrene/acrylate copolymer, a styrene/methacrylate copolymer, a styrene/α-chloromethyl methacrylate copolymer, a styrene/acrylonitrile copolymer, a styrene/methyl vinyl ether copolymer, a styrene/ethyl vinyl ether copolymer, a styrene/methyl vinyl ketone copolymer, a styrene/butadiene copolymer, a styrene/isoprene copolymer, and a styrene/acrylonitrile/indene copolymer; polyvinyl chloride, phenol resins, natural resin modified phenol resins, natural resin modified maleic acid resins, acrylic resins, methacrylic resins, polyvinyl acetate, silicone resins, polyester resins, polyurethanes, polyamide resins, furan resins, epoxy resins, xylene resins, polyvinyl butyral, terpene resins, cumarone-indene resins, and petroleum resins.

In the case of a heating press roller fixing system in which an oil is little applied, important problems are the offset phenomenon that part of toner images on a toner image supporting member such as plain paper is transferred to the roller, and the adhesion of toner to such a toner image supporting member. Toners capable of being fixed by a small heat energy usually have the properties of causing blocking or caking during storage or in a developing device, and therefore these problems also must be taken into account at the same time. What are most responsible for these phenomena are physical properties of the binder resin contained in toners. According to the researches made by the present inventors, the adhesion of toner to a toner image supporting member at the time of fixing can be improved when the content of a magnetic material in the toner is decreased, but on the other hand the offset tends to occur and also &he blocking or caking tends to be caused. For this reason, it is more important to select binder resins when the heating press roller fixing system in which an oil is little applied is used in the present invention. Preferred binder materials include crosslinked styrene copolymers or cross-linked polyesters.

Comonomers for styrene monomers in the styrene copolymers include monocarboxylic acids having a double bond, or substitution products thereof, such as acrylic acid, methyl acrylate, ethyl acrylate, butyl acrylate, dodecyl acrylate, octyl acrylate, 2-ethylhexyl acrylate, phenyl acrylate, methacrylate, methyl methacrylate, ethyl methacrylate, butyl methacrylate, octyl methacrylate, acrylonitrile, methacrylonitrile, and acrylamide; dicarboxylic acids having a double bond, or substitution products thereof, such as maleic acid, butyl maleate, methyl maleate, and dimethyl maleate: vinyl esters such as vinyl chloride, vinyl acetate, and vinyl benzoate; ethylenic olefins such as ethylene, propylene, and butylene; vinyl ketones such as methyl vinyl ketone, and hexyl vinyl ketone: and vinyl ethers such as methyl vinyl ether, ethyl vinyl ether, and isobutyl vinyl ether. These vinyl monomers are used alone or in combination of two or more of them.

Here, compounds having two or more polymerizable double bonds are mainly used as cross-linking agents. They include, for example, aromatic divinyl compounds such as divinyl benzene, and divinyl naphthalene; carboxylates having two double bonds, such as ethylene glycol diacrylate, ethylene glycol dimethacrylate, and 1,3-butanediol dimethacrylate; divinyl compounds such as divinyl aniline, divinyl ether, divinyl sulfide, and divinyl sulfone; and compounds having three or more vinyl groups. These are used alone or in the form of a mixture.

In the case when a pressure fixing system is used, it is possible to use binder resins for pressure fixing toners. They include, for example, polyethylene, polypropylene, polymethylene, polyurethane elastomers, an ethylene/ethyl acrylate copolymer, an ethylene/vinyl acetate copolymer, ionomer resins, a styrene/butadiene copolymer, a styrene/isopurene copolymer, linear saturated polyesters, and paraffins.

In order to control the quantity of triboelectricity, the magnetic toner of the present invention may preferably contain a charge control agent, which may be compounded into toner particles (i.e., internal addition) or mixed with toner particles (i.e., external addition). The charge control agent makes it possible to control an optimum quantity of triboelectricity according to the types of developing systems and, in particular, makes it possible to more stabilize the balance between particle size distribution and triboelectricity quantity.

Known compounds ca be used as negative chargeability control agents used in the present invention. They include, for example, carboxylic acid derivatives and metal salts thereof, alkoxylates, organic metal complexes, and chelate compounds, which can be used alone or in combination of two or more kinds. Of these, particularly preferably used are acetyl acetone metal complexes, salicylic acid metal complexes, salicylic acid metal complexes having an alkyl substituent, naphthoic acid metal complexes, and monoazo metal complexes.

The charge control agent described above may preferably be used in the form of fine particles. In such an instance, the charge control agents may preferably have a number average particle diameter of not more than 4 μm, and more preferably not more than 3 μm.

The charge control agent, when internally added to toner particles, may preferably be used in an amount of from 0.1 part by weight to 20 parts by weight, and more preferably from 0.2 part by weight to 10 parts by weight, based on 100 parts by weight of the binder resin.

Into the magnetic toner according to the present invention, various additives may be optionally mixed by internal addition or external addition. Conventionally known dyes and/or pigments can be used as coloring agents. These may usually be used in an amount of 0.5 part by weight to 20 parts by weight based on 100 parts by weight of the binder resin. Other additives include lubricants such as zinc stearate, abrasives such as cerium oxide and silicon carbide, fluidity providing agents or anti-caking agents such as colloidal silica and aluminum oxide, and conductivity-providing agents such as carbon black and tin oxide.

For the purpose of improving releasability at the time of heat roll fixing, waxy materials such as a low-molecular weight polyethylene, a low-molecular weight polypropylene, microcrystalline wax, carnauba wax, sasol wax and paraffin wax may be added in an amount approximately of from 1.5 part by weight to 5 parts by weight based on the binder resin. This is also one of the preferred embodiments of the present invention.

The magnetic toner of the present invention further contains a magnetic material, which may serve as a coloring agent at the same time. The magnetic material contained in the magnetic toner of the present invention includes iron oxides such as magnetite, γ-iron oxide, ferrite, and iron-excess ferrite; metals such as iron, cobalt and nickel, or alloys or mixtures of any of these metals with any of metals such as aluminum, cobalt, copper, lead, magnesium, tin, zinc, antimony, beryllium, bismuth, cadmium, calcium, manganese, selenium, titanium, tungsten and banadium.

These ferromagnetic materials may preferably be those having an average particle diameter of from 0.1 μm to 1 μm, and more preferably from 0.1 μm to 0.5 μm. The magnetic material may be contained in the magnetic toner in an amount of from 50 parts by weight to 150 parts by weight based on 100 parts by weight of the resin component, and preferably from 60 parts by weight to 120 parts by weight based on 100 parts by weight of the resin component.

The magnetic toner according to the present invention, for developing an electrostatic latent image can be prepared by thoroughly mixing a magnetic powder and vinyl type or non-vinyl type thermoplastic resin, optionally together with a pigment or dye as a coloring agent, a charge control agent and other additives by means of a mixing machine such as a ball mill, thereafter melting and kneading the mixture by the use of a heat kneading machine such as a heating roll, a kneader or an extruder so that resins are mutually compatibilized and the pigment or dye is dispersed and dissolved therein, and cooling the resulting product to effect solidification, followed by crushing, pulverization and then strict classification. The magnetic toner according to toner carrying member can be thus obtained.

Into the magnetic toner according to the present invention fine silica powder may be mixed by internal addition or external addition. Mixing by external addition is preferred.

The magnetic toner that characterizes the present invention may have a poor fluidity in some instances, and has a possibility of showing no sufficient ability of triboelectric charging depending on developing devices.

A fine silica powder may be mixed in the magnetic toner of the present invention by external addition, whereby the fluidity can be improved and the opportunities of contact with a triboelectric charge-providing member can be increased. Thus, the ability of triboelectrically charging the magnetic toner in a larger quantity can be effectively exercised and a good developability can be shown in various developing devices.

The magnetic toner having the particle size distribution that characterizes the present invention also results in a larger specific surface area than conventional toners. When magnetic toner particles are brought into contact with the surface of a cylindrical conductive sleeve having in its inner part a means for generating magnetic fields, the times for the contact between toner particle surfaces and the sleeve may become more than those in the conventional toners, tending to cause wear of toner particles. Use of the magnetic toner according to the present invention in combination with a fine silica powder can bring about a remarkable decrease in the wear because of the interposition of fine silica powder between the toner particles and the sleeve surface. This makes it possible to elongate the lifetime of the magnetic toner and also to maintain stable chargeability, so that a better magnetic toner can be given even for a long-term use.

Both of fine silica powder produced by the dry process and fine silica powder produced by the wet process can be used as the fine silica powder. From the viewpoint of filming resistance and durability, it is preferred to us the fine silica powder produced by the dry process.

The dry process herein referred to is a process for producing a fine silica powder by vapor phase oxidation of a silicon halide. For example, it is a process that utilizes heat decomposition oxidation reaction of silicon tetrachloride gas in oxygen and hydrogen. The reaction basically proceeds as follows.

$$SiCl_4+2H_2+O_2 \rightarrow SiO_2+4HCl$$

In this preparation step, it is also possible to use other metal halide such as aluminum halide or titanium chloride together with the silicon halide to give a composite fine powder of silica and another metal oxide. The fine silica powder herein referred to includes these, too.

As for the method in which the fine silica powder used in the present invention is produced by the wet process, various conventionally known methods can be applied. For example, they include a method of forming it by the decomposition of sodium silicate in the presence of an acid, a reaction scheme of which is shown below.

$$Na_2O{\cdot}XSiO_2+HCl+H_2O \rightarrow SiO_2{\cdot}nH_2O+NaCl$$

Besides, they include the decomposition of sodium silicate in the presence of ammonium salts or alkali salts, a method in which an alkaline earth metal silicate is produced from sodium silicate, followed by decomposition in the presence of an acid to form silicic acid, a method in which a sodium silicate solution is formed into silicic acid through an ion-exchange resin, and a method in which naturally occurring silicic acid or silicate is utilized.

In the fine silica powder herein referred to, it is possible to apply anhydrous silicon dioxide (silica), as well as silicates such as aluminum silicate, sodium silicate, potassium silicate, magnesium silicate, and zinc silicate.

Of the above fine silica powder, a product that can bring about good results is a fine silica powder having a specific surface area of not less than 30 $m^2/g$, and particularly in the range of from 50 $m^2/g$ to 400 $m^2/g$, as measured by the BET method, according to nitrogen adsorption. The fine silica powder should be used in an amount of from 0.01 part by weight tO 8 parts by weight, and preferably from 0.1 part by weight to 5 parts by weight, based on 100 parts by weight of the magnetic toner.

The fine silica powder used in the present invention may be subjected to surface treatment for the purpose of making the powder hydrophobic and making the chargeability stable. Agents for such treatment are exemplified by a silane coupling agent, a silicone varnish, a silicone oil or an organosilicon compound. These may have functional groups. The fine silica powder is treated with the above agent capable of reacting with, or being physically adsorbed on, the silica fine powder. Such an agent for the treatment includes hexamethyldisilazane, trimethylsilane, timethylchlorosilane, timethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylohlorosilane. triorganosilyl mercaptan, trimethylsilyl mercaptan, triorganosilyl acrylate, vinyldimethylacetoxysilane, dimethylethoxysilane, dimethyldimethoxysilane, diphenyldiethoxysilane, aminopropyltrimethoxysilane, aminopropyltriethoxysilane, dimethylaminopropyltrimethoxysilane, diethylaminopropyltrimethoxysilane, dipropylaminopropyltrimethoxysilane, dibutylaminopropyltrimethoxysilane, monobutylaminopropyltrimethoxysilane, dioctylaminopropyltrimethoxysilane, dibutylaminopropylmethyldimethoxysilane, dibutylaminopropyldimethylmonomethoxysilane, dimethylaminophenyltriethoxysilane, trimethoxysilyl-γ-propylphenylamine, trimethoxysilyl-γ-propylbenzylamine, trimethoxysilyl-γ-propylpiperidine, trimethoxysilyl-γ-propylmorpholine, trimethoxysilyl-γ-propylimidazole, hexamethyldisiloxane, 1,3-divinyltetramethyldisiloxane, 1,3-diphenyltetramethyldisiloxane, and a dimethylpolysiloxane having 2 to 12 siloxane units per molecule and containing a hydroxyl group bonded to each Si in the units positioned at the terminals.

The silicone oil, unmodified, is commonly represented by the following formula:

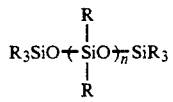

wherein R represents an alkyl group and n represents an integer.

As a preferred silicone oil, a silicone oil with a viscosity of from about 5 cSt to 5,000 cSt at 25° C. is used. For example, preferred are methylsilicone oil, dimethylsilicone oil, phenylmethylsilicone oil, chlorophenylmethylsilicone oil, an alkyl-modified silicone oil, a fatty acid-modified silicone oil, an amino-modified silicone oil and a polyoxyalkyl-modified silicone oil. These may be used alone or in the form of a mixture of two or more kinds.

In the treatment as described above, a single treatment may be applied or various treatments may be applied in combination.

The desired effect can be exhibited when the treated fine silica powder is used in an amount of from 0.01 part by weight to 8 parts by weight based on 100 parts by weight of the negatively chargeable magnetic toner. Negative chargeability with a superior stability can be shown when it is used particularly preferably in an amount of from 0.1 part by weight to 5 parts by weight. To describe a preferred embodiment of the form for its addition, the treated fine silica powder is in the state that it is adhered to toner particles surfaces in an amount of from 0.1 part by weight to 3 parts by weight based on 100 parts by weight of the negatively chargeable magnetic toner. The untreated fine silica powder previously described may also be used in the same amount as described here.

In the negatively chargeable magnetic toner according to the present invention, fine powder of a metal oxide, fine powder of a fluorine-containing polymer and another resin fine powder may be mixed by internal addition or external addition.

The fine powder of fluorine-containing polymer includes that of polytetrafluoroethylene, polyvinylidene fluoride or a tetrafluoroethylene/vinylidene fluoride copolymer. In particular, it is preferred in view of fluidity and abrasive properties to use polyvinylidene fluoride fine powder. The polymer may be added in an amount of from 0.01 part by weight to 2.0 parts by weight, and particularly from 0.02 part by weight to 1.0 part by weight, based on the toner.

The metal oxide fine powder includes fine powders of cerium oxide, strontium titanate, barium titanate, titania or alumina. The powder may be added in an amount of from 0.01 part by weight to 10.0 parts by weight, and particularly from 0.1 part by weight to 7 parts by weight, based on the toner.

In particular, although the reason is unclear, the state of presence of the silica adhered to toner can be stabilized in a magnetic toner comprising a combination of the fine silica powder and the above fine powder, mixed by external addition. For example, it may not occur that the silica adhered is released from toner to decrease the effect of preventing wear of the toner or contamination of the sleeve. It is also possible to further increase charge stability.

Figure 1:
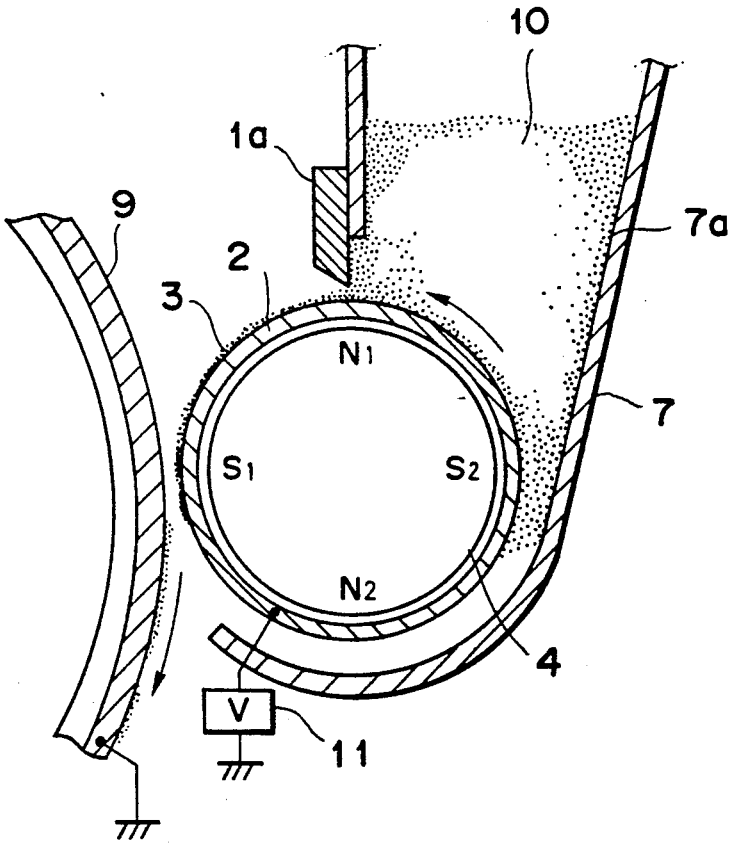
FIG. 1 is a schematic illustration of a developing device according go the present invention.

FIG. 1 illustrates an example of a specific device that can be used to carry out the developing process in the present invention.

In the developing device illustrated in FIG. 1, a sleeve made of stainless steel (SUS304)having a diameter of 50 mm, for example, is used as a non-magnetic sleeve 2. A magnet 4 in the sleeve is set to have magnetic poles consisting of $N_1$: 850 gausses, $N_2$: 500 gausses, $S_1$: 650 gausses and $S_2$: 500 gausses. A magnetic material, iron is used in a blade 1*a*. The gap between the blade 1*a* and the sleeve 2 is set to be 250 μm. As a toner 10, the magnetic toner according to the present invention is used. A bias electric source 11 may be comprised of an overlap of DC on AC (Vpp: 1,200 V; f: 800 Hz; DC: +100 V). The shortest distance between the sleeve 2 and a latent image carrying member 9 may be set to be 300 μm.

Figure 8:
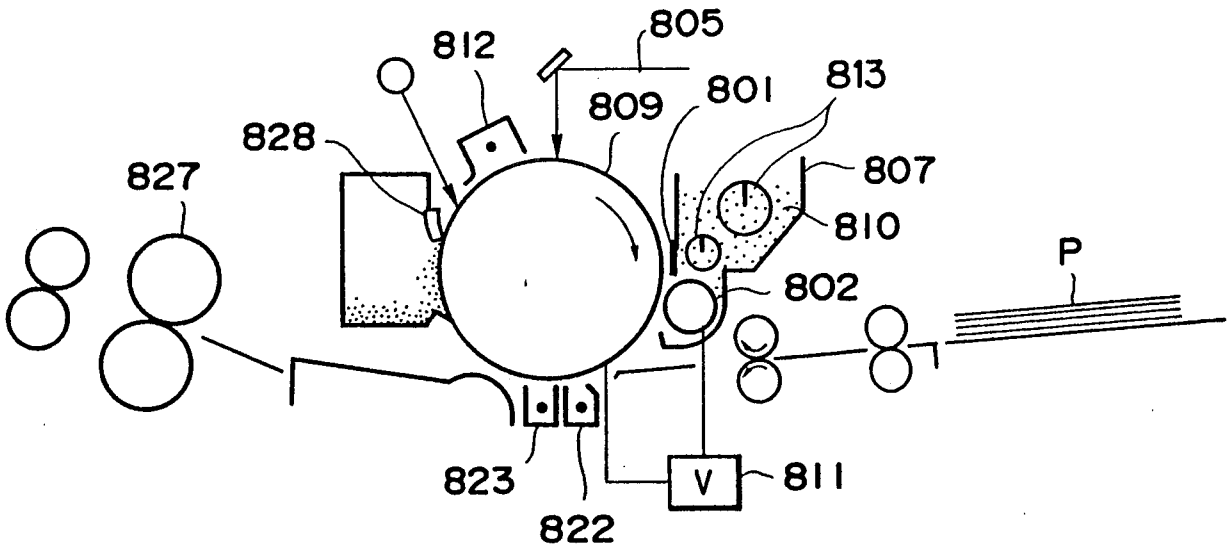
FIG. 8 is a schematic cross section of an image forming apparatus for carrying out the image forming method of the present invention.

The image forming method and apparatus of the present invention will be specifically described further, with reference to FIG. 8.

The surface of a photosensitive drum 809 such as an amorphous silicone drum is, for example, positively charged by the operation of a primary charging device 812, and an electrostatic latent image is formed by exposure 805. The latent image thus formed is developed using a one-component type magnetic developer 810 comprising the magnetic toner, held in a developing device 807 equipped with a developing sleeve 802 in the inner part of which a magnetic blade 801 and a magnet are provided. In the developing zone, an alternating bias, a pulse bias and/or a direct-current bias is/are applied between a conductive substrate of the photosensitive drum 809 and the developing sleeve 802 through a bias applying means 811. A transfer paper P is fed and delivered to a transfer zone, where the transfer paper P is electrostatically charged from its back surface (the surface opposite to the photosensitive drum) through a transfer means 822, so that the developed image (toner image) on the surface of the photosensitive drum is electrostatically transferred to the transfer paper P. The transfer paper P separated from the photosensitive drum 809 through an electrostatically separating means 823 is subjected to fixing using a heating press roller fixing unit (thermal platen) 827 so that the toner image on the transfer paper P can be fixed.

The magnetic toner remaining on the photosensitive drum 809 after the transfer step, is removed by the operation of a cleaning assembly 828 having a cleaning blade. After the cleaning, the residual charges on the photosensitive drum 809 is eliminated by erase exposure 826, and thus the procedure again starting from the charging step using the primary charging assembly 832 is repeated.

The photosensitive drum 809 (the latent image carrying member) comprises a photosensitive layer and a conductive substrate, and is rotated in the direction of the arrow. In the developing zone, the developing sleeve 802, a non-magnetic cylinder, which is a toner carrying member, is rotated so as to move in the same direction as the direction in which the photosensitive drum 809 is rotated. In the inner part of the non-magnetic cylindrical sleeve 802, a multi-polar permanent magnet (a magnet roll) serving as a magnetic field generating means is provided in an unrotatable state. The magnetic toner 810 held in the developing assembly 807 is coated on the surface of the non-magnetic developing sleeve 802, and minus triboelectric charges are imparted to magnetic toner particles as a result of the friction between the surface of the sleeve 802 and the toner particles. A magnetic doctor blade 801 made of iron is disposed opposingly to one of the magnetic pole positions of the multi-polar permanent magnet, in proximity (with a space of from 50 μm to 500 μm) to the surface of the cylindrical developing sleeve 802. Thus, the thickness of a magnetic toner layer can be controlled to be small (from 30 μm to 300 μm) and uniform so that a magnetic toner layer smaller in thickness than the gap between the photosensitive drum 809 and developing sleeve 802 in the developing zone can be formed in a non-contact state. The rotational speed of this developing sleeve 802 is regulated so that the peripheral speed of the sleeve can be substantially equal or close to the peripheral speed of the surface on which the electrostatic image is retained.

Since the image forming method and apparatus of the present invention are suited for high-speed development, the peripheral speed of the sleeve may preferably be not less than 300 mm/sec, more preferably not less than 400 mm/sec, and still more preferably not less than 500 mm/sec.

As the magnetic doctor blade 801, a permanent magnet may be used in place of iron to form an opposing magnetic pole. In the developing zone, the AC bias or pulse bias may be applied through the bias means 811, between the developing sleeve 802 and the photosensitive drum 809. This AC bias may have a frequency of from 200 Hz to 4,000 Hz, and a Vpp of from 500 V to 3,000 V.

When the magnetic toner particles are moved in the developing zone, they are moved to the latent image side by the electrostatic force of the photosensitive drum surface and the action of the AC bias or pulse bias.

In place of the magnetic doctor blade 801, an elastic blade formed of an elastic material such as silicone rubber may be used so that the layer thickness of the magnetic toner layer can be controlled by pressure and the toner can be thereby coated on the developing sleeve.

In the case when the image forming apparatus of the present invention is used as a printer of a facsimile machine, the optical image exposure 805 serves as exposure carried out for the printing of received data.

In the present invention, the weight of the toner layer per unit area on the sleeve is determined using what is called the suction type Faraday cage method. According to this suction type Faraday Cage method, a suction opening of an outer cylinder of the measuring apparatus is pressed against a sleeve and the toner in a given area on the sleeve is sucked up. The sucked toner is collected on a filter of an inner cylinder, and the weight of the toner layer per unit area on the sleeve can be calculated based on an increase in weight of the filter. This is also a method by which the quantity of triboelectricity per unit area on the sleeve can be simultaneously determined by measuring the quantity of triboelectricity accumulated on the inner cylinder which is electrostatically shielded from the outside.

A method of measuring the quantity of triboelectricity of the magnetic toner in the present invention will be described in detail with reference to a drawing.

Figure 6:
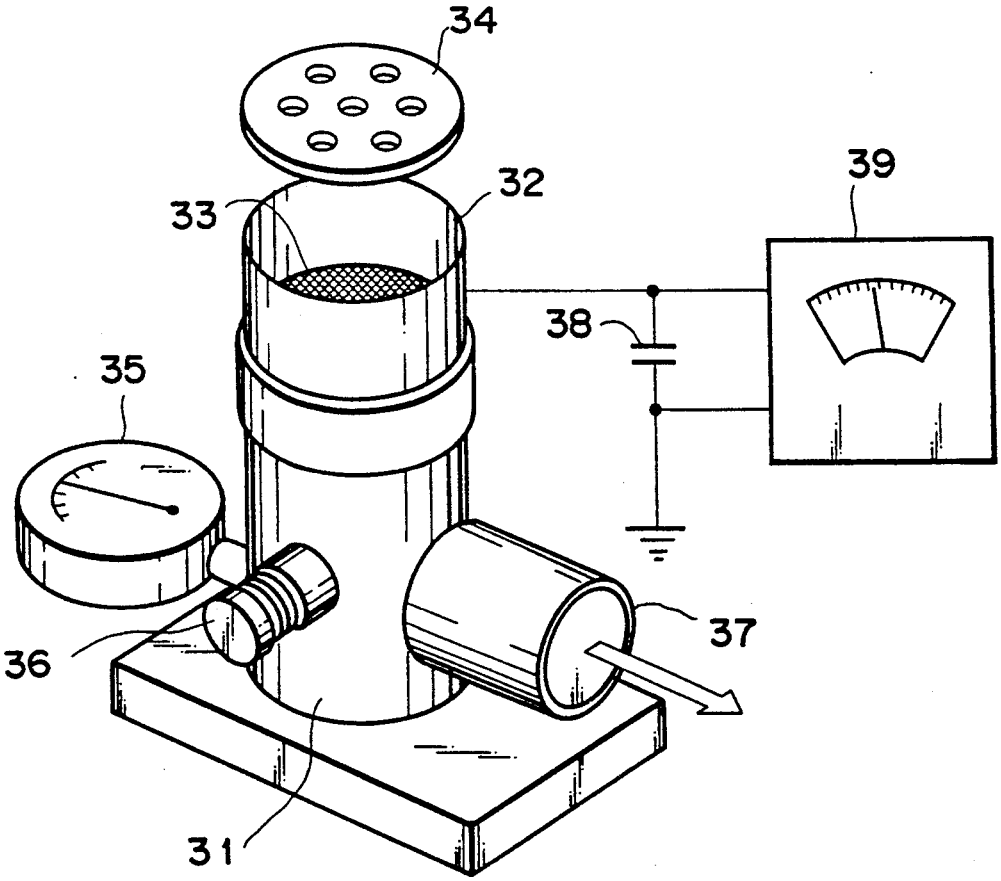
FIG. 6 is a schematic illustration of an apparatus for measuring the quantity of triboelectricity of a magnetic toner.
Figure 7:
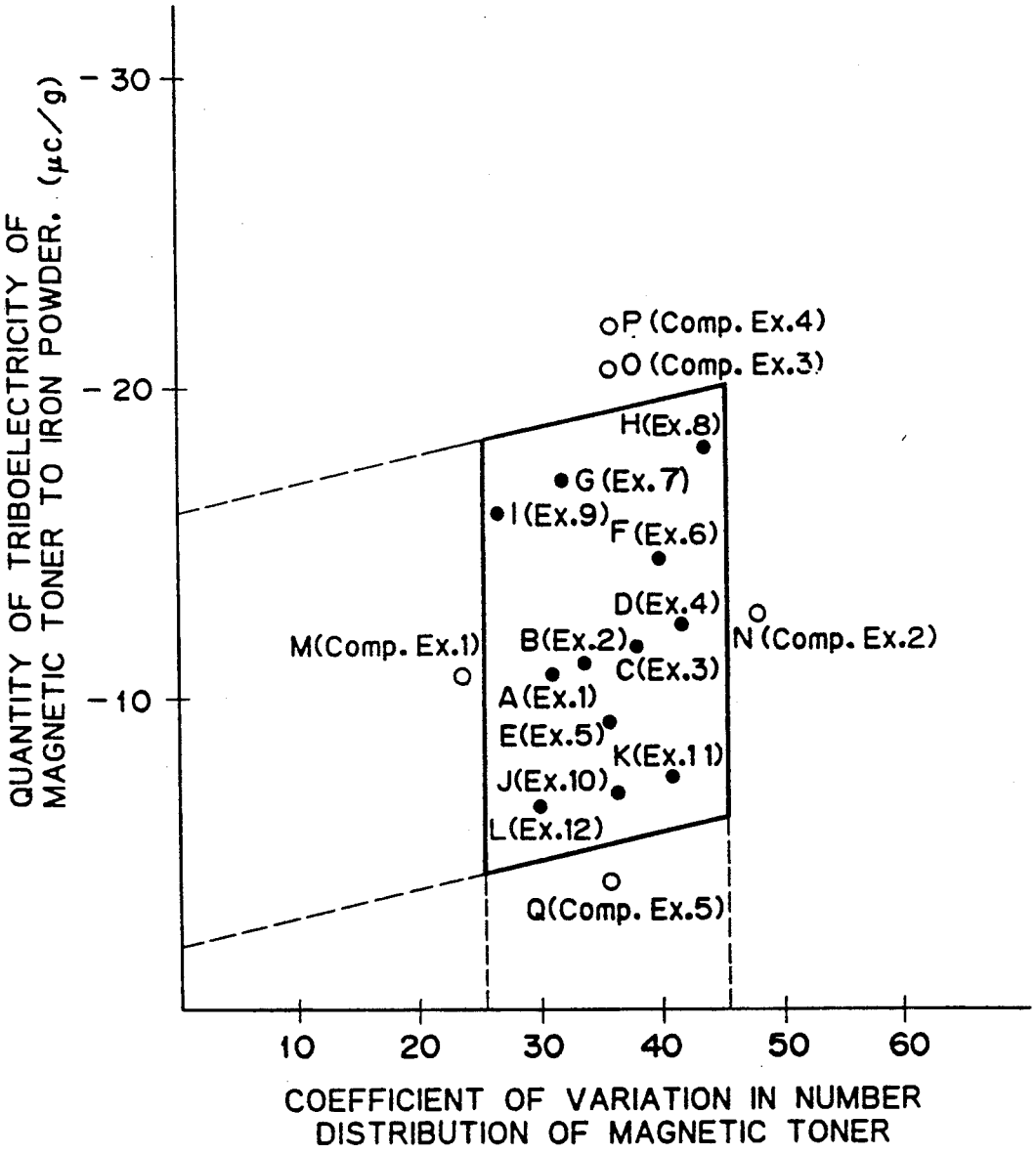
FIG. 7 is a representation in which the coefficient of variation of number distribution in magnetic toner particles and the quantity of triboelectricity (μc/g) are plotted.

FIG. 6 illustrates an apparatus for measuring the quantity of triboelectricity. In a measuring container 32 made of a metal at the bottom of which is provided a screen 33 of 400 meshes, about 1 g of a mixture of the magnetic toner the quantity of triboelectricity of which is to be measured and iron powder carrier (200 to 300 meshes) in weight ratio of 1:9 is put and the container is covered with a plate 34 made of a metal. The total weight of the measuring container 32 in this state is weighed and is expressed by $W_1$ (g). Next, in a suction device 31 (made of an insulating material at least at the part coming into contact with the measuring container 32), air is sucked from a suction opening 37 and an air-flow control valve 36 is operated to control the pressure indicated by a vacuum indicator, 35 to be 250 $mmH_2O$. In this state, suction is sufficiently carried out (for about 1 minute) to remove the toner by suction. The potential indicated by a potentiometer 39 at this time is expressed by V (volt). Here, the numeral 38 denotes a capacitor, whose capacitance is expressed by C (μF). The total weight of the measuring container after completion of the suction is also weighed and is expressed by $W_2$ (g) The quantity of triboelectricity is calculated as shown by the following equation.

$$\text{Quantity of triboelectricity } (\mu c/g) = \frac{C \times V}{W_1 - W_2}$$

The measurement is carried out under conditions of 23° C. and 60% RH. The carrier (iron powder) used for the measurement has a size of 200 to 300 meshes. In order to avoid an error, the carrier is sufficiently sucked with the above suction apparatus so that the powder passing through the 400 mesh screen is removed, and then mixed with the magnetic toner. They are mixed in about 30 minutes.

The present invention will be described below in greater detail by giving Examples. Unless otherwise stated, "part(s)" refers to "part(s) by weight".

EXAMPLE 1

The surface of a cylindrical stainless steel sleeve (SUS304) having in its inner part a magnet, which can be fitted to an electrophotographic copying machine NP-8580 (manufactured by Canon Inc.; an electrostatic separation system; sleeve peripheral speed: 605 mm/sec) having the device constitution as schematically and partially shown in FIG. 5 and having an amorphous silicone drum, was blast-finished using particles with a uniform shape comprising glass beads 80 number % or more of which had diameters of 53 to 62 μm, under conditions of a blast nozzle diameter of 7 mm, a blast distance of 100 mm, an air pressure of 4 $kg/cm^2$ and a blast time of 2 minutes. The irregularities as shown in FIG. 9 were thus formed which were 53 to 62 μm in diameters R of spheres corresponding to plural sphere traced concavities. The irregularities on this sleeve surface had a pitch P of 33μ and a surface roughness d of 2.0μ. The sleeve thus surface-treated was fitted to the copying machine NP-8580.

As for a magnetic toner, the following was used.

| | |
|---|---|
| Styrene/butyl acrylate/butyl maleate/divinylbenzene copolymer (monomer polymerization weight ratio: 72.0/24.0/3.0/1.0; weight average molecular weight (Mw): 350,000) | 100 parts |
| Magnetic iron oxide (average particle diameter: 0.18 μm) | 80 parts |
| Monoazo chromium complex | 1 part |
| Low-molecular weight ethylene/propylene copolymer | 4 parts |

The above materials were thoroughly blended with a blender, and thereafter kneaded using a twin-screw kneading extruder set to a temperature of 150° C. The resulting kneaded product was cooled, and crushed with a cutter mill. Thereafter, the crushed product was pulverized using a fine-grinding mill making use of a jet stream, under air pressure of 6 kg/cm$^2$. The resulting pulverized product was classified using a fixed-wall type air classifier to produce classified powders. Using a multi-division classifying apparatus (Elbow Jet classifier; manufactured by Nittetsu Kogyo K.K.) utilizing the Coanda effect, the classified powders thus obtained were further classified to remove the ultra-fine powder and coarse powder simultaneously. A magnetic toner A with a volume average particle diameter of 8.4 μm was thus obtained.

The variation coefficient of number distribution of this magnetic toner A was confirmed to be 31.8.

The particle size distribution of the resulting magnetic toner gas measured using the Coulter counter TA-II type equipped with an aperture of 100μ, as previously described. Data obtained and the quantity of triboelectricity to iron powder, also measured as previously described, are shown in Table 1.

To 100 parts of the magnetic toner obtained, 0.5 part of hydrophobic dry-process silica (BET specific surface area: 300 m$^2$/g) was added, and these were blended with a Henschel mixer to prepare the magnetic toner A having the fine silica powder on the surfaces of magnetic toner particles.

The resulting magnetic toner A was fed to the electrophotographic copying machine NP 8580 fitted with the sleeve previously described, having the surface as shown in FIG. 9, and image-producing tests to develop the positively charged latent image formed on the amorphous silicone drum were carried out at a sleeve peripheral speed of 605 mm/sec in an environment of low temperature and low humidity (temperature: 15° C.; humidity: 10% RH). The image-producing producing tests were continuously carried out 10,000 times (10,000 sheets of A4-size transfer paper) to obtain the results as shown in Table 2. As will be evident from Table 2, the weight M/S of the toner layer per unit area on the sleeve showed a proper value of 1.29 mg/cm$^2$ at the initial stage, and also the M/S was as stable as 1.35 mg/cm$^2$ even after running for 10,000 sheet copying. The toner coat on the sleeve was also in a very uniform state. After the running for 10,000 sheet copying, the surface of the sleeve was air-cleaned and thereafter observed with a scanning electron microscope to confirm that none of the constituents of the magnetic toner were adhered to the irregularities of the sleeve surface and substantially no sleeve contamination occurred. Both the toner images obtained at the initial stage and the toner images obtained after running for 10,000 sheet copying had a high image density, were fog-free and sharp, and had a high image quality with superior resolution, fine-line reproduction, half-tone dot reproduction and gradation.

Similarly good results were also obtained in durability tests carried out in an environment of high temperature and high humidity (temperature: 32.5° C.; humidity 85% RH).

EXAMPLES 2 to 6

Magnetic toners B (Example 2), C (Example 3), D (Example 4) and E (Example 5) were respectively prepared from the pulverized product obtained in Example 1, by variously controlling the classification conditions, and a magnetic toner F (Example 6) was also prepared in the same manner as in Example 1 except that the monoazo chromium complex among the materials in Example 1 was used in an amount of 0.5 part. The resulting magnetic toners each had the particle size distribution as shown in Table 1.

In the magnetic toners B and D, the materials were blended in the same manner as in Example 1 except for addition of 2.0 part of an additive, strontium titanate.

Evaluation was made in the same manner as in Example 1 to obtain the results as shown in Table 2.

EXAMPLE 7

| | |
|---|---|
| Cross-linked polyester resin ($\overline{M}$w: 60,000) | 100 parts |
| Magnetic iron oxide (average particle diameter: 0.22 μm) | 80 parts |
| 3,5-Di-tert-butylsalicylic acid chromium complex | 1 part |
| Low-molecular weight ethylene/propylene copolymer | 3 parts |

Using the above materials, a magnetic toner G with the particle size distribution as shown in Table 1 was prepared in the same manner as in Example 1. To 100 parts of the magnetic toner G obtained, 0.6 part of hydrophobic dry-process silica (BET specific surface area: 300 m$^2$/g) was added, and these were blended with a Henschel mixer to prepare a magnetic toner G having the fine hydrophobic silica powder. Evaluation was made in the same manner as in Example 1. Results obtained are shown in Table 2. As shown therein, both the toner images obtained at the initial stage and the toner images obtained after running for 10,000 sheet copying had a high image density, were fog-free and sharp, and had a high image quality. There were also seen neither contamination of the sleeve nor toner coat uneveness on the sleeve.

EXAMPLES 8 and 9

Magnetic toners H and I were respectively prepared from the pulverized product obtained in Example 1, by differently controlling the classification conditions.

These magnetic toners were evaluated in the same manner as in Example 1. Results obtained are shown in Table 2.

EXAMPLE 10

| | |
|---|---|
| Styrene/butyl acrylate/divinylbenzene copolymer (monomer polymerization weight ratio: 70/29.5/0.5; Mw: 300,000) | 100 parts |
| Magnetic iron oxide (average particle diameter: 0.18 μm) | 80 parts |
| 3,5-Di-tert-butylsalicylic acid zinc complex | 2 parts |
| Low-molecular weight ethylene/propylene copolymer | 3 parts |

Using the above materials, a magnetic toner J with the particle size distribution as shown in Table 1 was prepared in the same manner as in Example 1. To 100 parts of the magnetic toner J obtained, 0.6 part of hydrophobic silica (BET specific surface area: 200 $m^2/g$) was added, and these were blended with a Henschel mixer to prepare a magnetic toner J having the fine hydrophobic silica powder. Evaluation was made in the same manner as in Example 1.

Results obtained are shown in Table 2.

EXAMPLES 11 AND 12

Magnetic toners K and L each having the particle size distribution as shown in Table 1 were respectively prepared from the pulverized product obtained in Example 10.

These magnetic toners were evaluated in the same manner as in Example 1. Results obtained are shown in Table 2.

EXAMPLE 13

Figure 10:
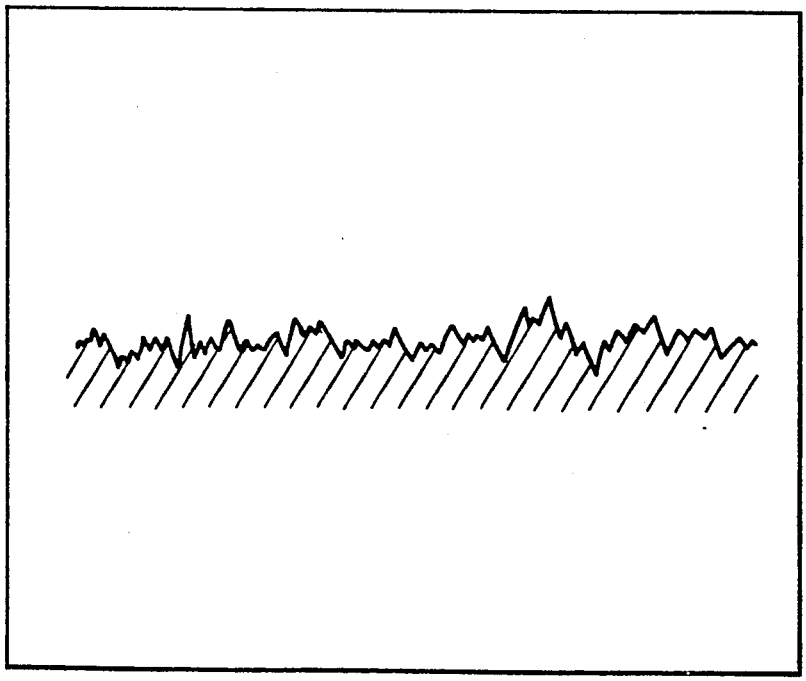
FIG. 10 is a partial cross section to schematically illustrate the surface of a sleeve having been blast-finished using amorphous particles.

The surface treatment on the sleeve was carried out in the same manner as in Example 1 except that the glass beads used in Example 1 was replaced with amorphous particles (#400 carbon random). A sleeve having the surface as shown in FIG. 10 was thus produced. Evaluation was made in the same manner as in Example 1 except that the sleeve and the magnetic toner, used in Example 1, were replaced with the above sleeve and the magnetic toner B, respectively, Results obtained are shown in Table 2.

Fog-free, sharp images were obtained at the initial stage, but a slight lowering of image density was seen on the images obtained after running for 10,000 sheet copying. After the running, the sleeve surface was air-cleaned and observed with a scanning electron microscope. As a result, toner constituents were seen to have adhered on the sleeve surface, and thus the sleeve was found to have been contaminated.

EXAMPLE 14

A sleeve was blast-finished in the same manner as in Example 1 except that the surface of the sleeve obtained in the same manner as in Example 13 was treated using particles with a uniform shape comprising glass beads 80 number % or more of which had diameters of 150 to 180 μm, and in a blasting time of 1 minute. Evaluation was made in the same manner as in Example 1 except that the above sleeve and the magnetic toner B were used. Results obtained are shown in Table 2.

EXAMPLE 15

In Example 1, the sleeve surface was not blast-finished with the particles with a uniform shape and instead rubbed with an abrasive comprising fine powder of cerium oxide so that the sleeve surface was finished to give a smooth mirror surface. Evaluation was made in the same manner as in Example 1 except that the sleeve used in Example 1 was replaced with this sleeve having a smooth surface and the magnetic toner B was used. Results obtained are shown in Table 2.

Fog-free, sharp images with high density were obtained, but with a slightly poor gradation, compared with those of Example 2.

COMPARATIVE EXAMPLE 1

A magnetic toner M having the volume average particle diameter and particle size distribution as shown in Table 1 was prepared in the same manner as in Example 1.

The magnetic toner M made to have the hydrophobic silica in the same manner as in Example 1 was evaluated in the same manner as in Example 1. Results obtained are shown in Table 2.

When the magnetic toner M was used, good images were obtained at the initial stage, but a partial uneveness appeared in the toner coat layer on the sleeve in the course of running for copying on a large number of sheets. At image areas corresponding to that uneveness, defective images, and light and shade fogging were recognized.

COMPARATIVE EXAMPLE 2

A magnetic toner N having the volume average particle diameter and particle size distribution as shown in TabIe 1 was prepared in the same manner as in Example 1.

The magnetic toner N made to have the hydrophobic silica in the same manner as in Example 1 was evaluated in the same manner as in Example 1. Results obtained are shown in Table 2.

When the magnetic toner N was used, images obtained both at the initial stage and after running for 10,000 sheet copying had a low image density with conspicuous fogging, compared with those of Example 1, and were thus unsatisfactory.

COMPARATIVE EXAMPLE 3

The crushed product obtained in Example 7 was pulverized using a pulverizer of a mechanical type making use of a rotor and a liner, and the pulverized product was classified in the same method as in Example 1. A magnetic toner O as shown in Table 1 was thus obtained.

The magnetic toner O was made to have hydrophobic silica in the same manner as in Example 7, and evaluation was made in the same manner as in Example 1. Results obtained are shown in Table 2.

Good images were obtained at the initial stage, but a coat uneveness occurred on the sleeve in the course of the running, bringing about defective images.

COMPARATIVE EXAMPLE 4

| | |
|---|---|
| Styrene/butyl acrylate/butyl maleate/divinylbenzene copolymer (monomer polymerization weight ratio: 72.0/24.0/3.0/1.0: Mw: 350,000) | 100 parts |
| Magnetic iron oxide (average particle diameter: 0.18 μm) | 70 parts |
| 3,5-Di-tert-butylsalicylic acid chromium complex | 3 parts |
| Low-molecular weight ethylene/propylene copolymer | 3 parts |

Using the above materials, a crushed product obtained in the same manner as in Example 1 was pulverized using a fine-grinding mill making use of a jet stream, under air pressure of 3 $kg/cm^2$. This pulverization was repeated three times. The pulverized product was classified in the same method as in Example 1 to give a magnetic toner P as shown in Table 1.

The magnetic toner p was made to have hydrophobic silica in the same manner as in Example 1, and evaluation was made in the same manner as in Example 1. Results obtained are shown in Table 2.

Good images were obtained at the initial stage, but a coat uneveness occurred on the sleeve in the course of the running, bringing about defective images.

COMPARATIVE EXAMPLE 5

| | |
|---|---|
| Styrene/butyl acrylate/divinylbenzene copolymer (monomer polymerization weight ratio: 75/24.6/0.5; Mw: 300,000) | 100 parts |
| Magnetic iron oxide (average particle diameter: 0.18 μm) | 90 parts |
| 3,5-Di-tert-butylsalioylic acid zinc complex | 1 part |
| Low-molecular weight ethylene/propylene copolymer | 3 parts |

Using the above materials, a magnetic toner Q as shown in Table 1 was prepared in the same manner as in Example 1.

The magnetic toner Q was made to have hydrophobic silica in the same manner as in Example 1, and evaluation was made in the same manner as in Example 1. Results obtained are shown in Table 2.

Compared with Example 1, the images had a low image density with slightly more fogging.

TABLE 1

| Toner | Toner particle size distribution: Volume average particle diameter (μm) | Number average particle diameter (μm) | Standard deviation S | Variation coefficient A | Quantity of tribo. of toner Q (μc/g) |
|---|---|---|---|---|---|
| Present invention: | | | | | |
| A | 8.41 | 6.75 | 2.15 | 31.8 | −11.0 |
| B | 8.44 | 6.59 | 2.21 | 33.6 | −11.4 |
| C | 8.47 | 6.24 | 2.34 | 37.5 | −11.9 |
| D | 8.42 | 5.91 | 2.43 | 41.2 | −12.7 |
| E | 8.49 | 6.42 | 2.28 | 35.5 | −11.5 |
| F | 8.45 | 6.11 | 2.39 | 39.1 | −14.8 |
| G | 7.26 | 5.84 | 1.85 | 31.7 | −17.1 |
| H | 7.89 | 5.32 | 2.31 | 43.4 | −18.3 |
| I | 7.54 | 6.33 | 1.68 | 26.5 | −16.2 |
| J | 9.06 | 6.67 | 2.41 | 36.1 | −7.2 |
| K | 9.21 | 6.51 | 2.61 | 40.1 | −7.7 |
| L | 9.10 | 7.56 | 2.24 | 29.7 | −6.7 |
| Comparative Example: | | | | | |
| M | 8.66 | 7.60 | 1.75 | 23.0 | −10.8 |
| N | 8.52 | 5.27 | 2.51 | 47.6 | −13.0 |
| O | 8.28 | 6.25 | 2.23 | 35.6 | −20.9 |
| P | 8.30 | 6.25 | 2.24 | 35.8 | −22.4 |
| Q | 8.24 | 6.28 | 2.21 | 35.2 | −4.9 |

TABLE 2

| | Toner | Initial stage: Image density | Initial stage: M/S mg/cm² | 10,000th sheet: Image density | 10,000th sheet: M/S mg/cm² | Sleeve coat unevenness | Transfer performance | Sleeve contamination | Gradation of toner image | Quantity of triboelect. of toner on sleeve μc/g |
|---|---|---|---|---|---|---|---|---|---|---|
| Example: | | | | | | | | | | |
| 1 | A | 1.41 | 1.29 | 1.43 | 1.35 | A | Good | A | A | −9 to −14 |
| 2 | B | 1.39 | 1.25 | 1.40 | 1.30 | A | Good | A | A | −8 to −14 |
| 3 | C | 1.35 | 1.24 | 1.37 | 1.25 | A | Good | A | A | −10 to −15 |
| 4 | D | 1.32 | 1.21 | 1.31 | 1.19 | A | Good | A | A | −11 to −16 |
| 5 | E | 1.31 | 1.05 | 1.38 | 1.26 | A | Good | A | A | −8 to −11 |
| 6 | F | 1.35 | 1.19 | 1.33 | 1.12 | A | Good | A | A | −12 to −16 |
| 7 | G | 1.42 | 1.51 | 1.43 | 1.62 | A | Good | A | A | −11 to −17 |
| 8 | H | 1.28 | 1.44 | 1.26 | 1.39 | A | Good | A | A | −12 to −17 |
| 9 | I | 1.40 | 1.62 | 1.40 | 1.81 | B | Good | A | B | −10 to −16 |
| 10 | J | 1.37 | 1.25 | 1.38 | 1.28 | A | Good | A | B | −8 to −10 |
| 11 | K | 1.30 | 1.15 | 1.30 | 1.12 | A | Good | A | A | −9 to −12 |
| 12 | L | 1.39 | 1.32 | 1.38 | 1.35 | A | Good | A | B | −7 to −13 |
| 13 | B | 1.36 | 1.30 | 1.30 | 1.10 | A | Good | C | B | −6 to −10 |
| 14 | B | 1.38 | 1.42 | 1.41 | 1.51 | A | Good | A | A | −8 to −12 |
| 15 | B | 1.42 | 1.51 | 1.44 | 1.77 | B | Good | A | C | −12 to −18 |
| Comparative Example: | | | | | | | | | | |
| 1 | M | 1.40 | 2.12 | — | — | C | Good | — | A | −12 |
| 2 | N | 1.07 | 0.97 | 1.03 | 1.01 | A | Good | A | C | −6 to −11 |
| 3 | O | 1.41 | 1.61 | — | — | C | Poor | — | B | −22 |
| 4 | P | 1.37 | 1.49 | — | — | C | Poor | — | B | −25 |
| 5 | Q | 0.97 | 0.99 | 1.05 | 1.05 | A | Poor | A | F | −4 to −6 |

Sleeve coat unevenness
A: No unevenness occurred.
B: Unevenness not appearing on image.
C: Unevenness appearing on image.
Sleeve contamination
A: Not occurred.
C: Occurred.
Gradation of toner image
A: Excellent
B: Good
C: Passable
F: Failure

I claim:

1. An image forming method comprising the steps of: feeding a magnetic toner comprised of particles onto a toner carrying member disposed with a given gap relative to a latent image carrying member, wherein said magnetic toner comprises a binder resin and a magnetic powder, said magnetic toner having a volume average particle diameter ranging from 7 μm to 10 μm, and a quantity of triboelectric charge of magnetic toner particles satisfying the following expression:

$$0.1\times A+2\leqq -Q\leqq 0.1\times A+16,$$

wherein A represents a real number ranging from 25 to 45 calculated as a coefficient of variation of number distribution, $(S/\overline{D}_1)\times 100$, wherein S represents a standard deviation of the number distribution of magnetic toner particles and $\overline{D}$ represents a number average magnetic toner particle diameter (μm), and Q represents a value of the quantity of triboelectric charge (μc/g) of the magnetic toner produced by friction with an iron powder;

triboelectrically charging said magnetic toner to impart a negative triboelectric charge to said magnetic toner;

forming an electrostatic latent image on said latent image carrying member;

developing said electrostatic latent image by using said magnetic toner having the negative triboelectric charge to form a toner image; and transferring said toner image formed on said latent image carrying member onto a transfer medium.

2. An image forming method according to claim 1, wherein said toner carrying member comprises a cylindrical sleeve having a magnet in its inner part.

3. An image forming method according to claim 2, wherein said cylindrical sleeve has an irregular surface formed by blast finishing with particles having a uniform shape.

4. An image forming method according to claim 3, wherein said particles having a uniform shape comprise spherical particles having diameters ranging from 20 μm to 250 μm.

5. An image forming method according to claim 3, wherein said cylindrical sleeve has an irregular surface with a surface roughness d of from 0.1 μm to 5 μm and an irregularity pitch of from 2 μm to 100 μm.

6. An image forming method according to claim 2, wherein said cylindrical sleeve is rotated at a peripheral speed of not less than 220 mm/sec.

7. An image forming method according to claim 2, wherein said cylindrical sleeve is rotated at a peripheral speed of not less than 300 mm/sec.

8. An image forming method according to claim 2, wherein said cylindrical sleeve is rotated at a peripheral speed of not less than 400 mm/sec.

9. An image forming method according to claim 2, wherein said cylindrical sleeve is rotated at a peripheral speed of not less than 500 mm/sec.

10. An image forming method according to claim 1, wherein said toner carrying member comprises a cylindrical sleeve having a magnet in its inner part, and said cylindrical sleeve has an irregular surface formed by blast finishing using figurate particles mainly composed of spherical particles having diameters ranging from 20 μm to 250 μm and wherein said cylindrical sleeve is rotated at a peripheral speed of not less than 400 mm/sec.

11. An image forming method according to claim 10, wherein said cylindrical sleeve is rotated at a peripheral speed of not less than 500 mm/sec.

12. An image forming method according to claim 1, wherein said magnetic toner contains the magnetic powder in an amount ranging from 50 parts by weight to 150 parts by weight based on 100 parts by weight of the binder resin.

13. An image forming method according to claim 1, wherein said magnetic toner contains the magnetic powder in an amount ranging from 60 parts by weight to 120 parts by weight based on 100 parts by weight of the binder resin.

14. An image forming method according to claim 1, wherein said magnetic toner has a hydrophobic fine silica powder.

15. An image forming method according to claim 1, wherein said magnetic toner has a coefficient of variation of number distribution, ranging from 26 to 44.

16. An image forming method according to claim 1, wherein said magnetic toner has a coefficient of variation of number distribution, ranging from 27 to 43.

17. An image forming method according to claim 1, wherein said magnetic toner has the following triboelectric charge characteristics $$0.1\times A+3\leqq -Q\leqq 0.1\times A+15.$$

18. An image forming method according to claim 1, wherein said magnetic toner has the following triboelectric charge characteristics $$0.1\times A+4\leqq -Q\leqq 0.1\times A+14.$$

19. An image forming method according to claim 1, wherein said magnetic toner has a quantity of triboelectricity R ranging from −6 μc/g to −19 μc/g on the toner carrying member, and the quantity of triboelectricity R has a difference from the quantity of triboelectricity Q ranging from 0 μc/g to 10 μc/g as an absolute value.

20. An image forming method according to claim 1, wherein the toner image on the latent image carrying member is electrostatically transferred to the transfer medium, and the transfer medium having the toner image is separated from the latent image carrying member through an electrostatic means.

21. An image forming method according to claim 1, wherein said toner carrying member is disposed with a gap ranging from 50 μm to 500 μm between it and the latent image carrying member, a magnetic toner layer on the toner carrying member has a thickness ranging from 30 μm to 300 μm, the magnetic toner layer has a thickness smaller than said gap, and a bias voltage is applied to the toner carrying member.

22. An image forming method according to claim 21, wherein an alternating-current bias with a frequency ranging from 200 Hz to 4,000 Hz and Vpp ranging from 500 V to 3,000 V and a direct-current bias are applied to the toner carrying member.

23. An image forming method according to claim 1, wherein A represents a real number ranging from 26.5 to 36.1.

24. An image forming method according to claim 1, wherein said magnetic toner has the following triboelectric charge characteristics, $$0.1\times A+4\leqq -Q\leqq 0.1\times A+14.$$

wherein A represents a real number ranging from 26.5 to 36.1.

25. An image forming method according to claim 1, wherein said toner carrying comprises a cylindrical sleeve having a magnet in its inner part, said cylindrical sleeve is rotated at a peripheral speed of not less than 300 mm/sec, and said magnetic toner has the following triboelectric charge characteristics, $$0.1 \times A + 4 \leqq -Q \leqq 0.1 \times A + 14.$$

wherein A represents a real number ranging from 26.5 to 36.1.

26. An image forming method according to claim 25, wherein said cylindrical sleeve is rotated at a peripheral speed of not less than 400 mm/sec.

27. An image forming method according to claim 25, wherein said cylindrical sleeve is rotated at a peripheral speed of not less than 500 mm/sec.

* * * * *

UNITED STATES PATENT AND TRADEMARK OFFICE

CERTIFICATE OF CORRECTION

PATENT NO. : 5,219,695

DATED : June 15, 1993

INVENTOR(S) : HIROHIDE TANIKAWA

It is certified that error appears in the above-identified patent and that said Letters Patent is hereby corrected as shown below:

COLUMN 1

Line 39, "blade Ia" should read --blade 1a--;
Line 41, "magnetic" should read --magnet--.

COLUMN 4

Line 51, "$S/\overline{D}_1$x100," should read --$(S/\overline{D}_1)$x100,--.

COLUMN 12

Line 16, "ca" should read --can--;
Line 55, "1.5 part" should read --0.5 part--.

COLUMN 14

Line 55, "timethylchlorosilane, timethylethoxysi" should read --trimethylchlorosilane, trimethylethoxysi--.
Line 60, "chloromethyldimethylohlorosilane." should read --chloromethyldimethylchlorosilane,--.

COLUMN 18

Line 42, "30 minutes" should read --30 seconds--.

COLUMN 22

Line 65, "toner p" should read --toner P--.

COLUMN 23

Comparative Example 5, "75/24.6/0.5;$\overline{M}$w:300,000)" should read --75/24.5/0.5;$\overline{M}$w:300,000)--, and "3,5-Di-tert-butylsalioylic" should read --3,5-Di-tert-butylsalicylic--.

COLUMN 26

Line 13, "distribution," should read --distribution--.
Line 16, "distribution," should read --distribution--.
Line 62, "0.1xA+4≤-Q≤0.1xA+14." should read --"0.1xA+4≤-Q≤0.1xA+14--.
Line 68, "carrying" should read --carrying member--.

UNITED STATES PATENT AND TRADEMARK OFFICE

CERTIFICATE OF CORRECTION

PATENT NO. : 5,219,695

DATED : June 15, 1993

INVENTOR(S) : HIROHIDE TANIKAWA

It is certified that error appears in the above-identified patent and that said Letters Patent is hereby corrected as shown below:

COLUMN 27

Line 7, "$0.1xA+4 \leq -Q \leq 0.1xA+14$." should read --"$0.1xA+4 \leq -Q \leq 0.1xA+14$--.

Signed and Sealed this

Twelfth Day of April, 1994

Bruce Lehman

*Attest:*

BRUCE LEHMAN

*Commissioner of Patents and Trademarks*

*Attesting Officer*